US007145495B2

(12) United States Patent
Cooper

(10) Patent No.: US 7,145,495 B2
(45) Date of Patent: Dec. 5, 2006

(54) PROCESS FOR DUPLICATING REMOTE CONTROL COMMAND CODES

(76) Inventor: Jeffrey Cooper, 12999 Murphy Rd., Suite C2, Stafford, TX (US) 77477

( * ) Notice: Subject to any disclaimer, the term of this patent is extended or adjusted under 35 U.S.C. 154(b) by 288 days.

(21) Appl. No.: 10/863,361

(22) Filed: Jun. 9, 2004

(65) Prior Publication Data

US 2005/0030152 A1 Feb. 10, 2005

Related U.S. Application Data

(60) Provisional application No. 60/476,616, filed on Jun. 9, 2003.

(51) Int. Cl.
*G08C 19/12* (2006.01)

(52) U.S. Cl. ..... 341/173; 347/176; 340/825.69; 340/825.72; 348/734

(58) Field of Classification Search ..... 341/173, 341/176; 340/825.69, 825.72; 348/734; 455/352

See application file for complete search history.

(56) References Cited

U.S. PATENT DOCUMENTS

| | | | | |
|---|---|---|---|---|
| 4,692,762 | A * | 9/1987 | Lewiner et al. | 340/825.69 |
| 4,856,081 | A * | 8/1989 | Smith | 455/151.4 |
| 4,999,622 | A * | 3/1991 | Amano et al. | 340/825.72 |
| 5,228,077 | A * | 7/1993 | Darbee | 379/102.01 |
| 5,471,668 | A * | 11/1995 | Soenen et al. | 455/352 |
| 5,852,478 | A * | 12/1998 | Kwoh | 348/734 |
| 5,945,936 | A * | 8/1999 | Issa | 341/176 |
| 6,181,255 | B1 * | 1/2001 | Crimmins et al. | 340/825.69 |
| 6,239,718 | B1 * | 5/2001 | Hoyt et al. | 340/825.22 |
| 6,633,281 | B1 * | 10/2003 | Lin et al. | 345/173 |

* cited by examiner

*Primary Examiner*—Albert K. Wong
(74) *Attorney, Agent, or Firm*—Drinker Biddle & Reath LLP; Joseph R. DelMaster, Jr.

(57) ABSTRACT

A system and process is disclosed for duplicating or replicating remote control units for automobile locks and other common purposes. The system comprises a device that reads the remote control signal codes in an existing keyfob device, analyzes the code for type, stores the code, then transfers the code into a replacement remote control device. The process for testing, reading, analyzing, storing and transferring the control codes is also disclosed.

1 Claim, 4 Drawing Sheets

2. TEST PROCEDURE

5. RECORDING PROCEDURE

9. TRANSFER WAS SUCCESSFUL

PROCESS FOR DUPLICATING REMOTE CONTROL COMMAND CODES

This application claims priority from a provisional application, Ser. No. 60/476,616 filed Jun. 9, 2003.

FIELD OF THE INVENTION

The invention is a system used to make functionally equivalent copies of working fixed code remote control transmitters. The invention applies to the replication of any working fixed code remote transmitter device.

BACKGROUND OF THE INVENTION

Most automobiles, and certain other vehicles and lockable structures, are now equipped with remote control locks that respond to a signal from a small "keyfob" that is typically carried about in the user's pocket. A problem arises when the user either loses the device or discovers that it is wearing out (the battery is dying). The present invention is directed to a system and process for replacing lost or non-functional remote control keyfobs that can be easily installed in shops convenient to the users as an alternative to revisiting a dealer to obtain a proprietary (and relatively expensive) replacement.

SUMMARY OF THE INVENTION

A process for duplicating the programming of a remote control device comprising the steps:

testing an existing remote control unit by activating a single control input on the unit;

receiving a signal from the existing remote control unit upon testing, said signal comprising a transmission frequency and a code having a type and content;

displaying a feedback message that confirms reception of said signal;

repeating the testing and receiving steps at least once more;

comparing the signals received from the remote control unit and determining the average frequency and the code type employed in the remote control unit;

storing the code content;

repeating the testing and storing for each control input on the remote control unit;

transferring the stored code into a replacement remote control unit.

DESCRIPTION OF THE INVENTION

Figure 1:
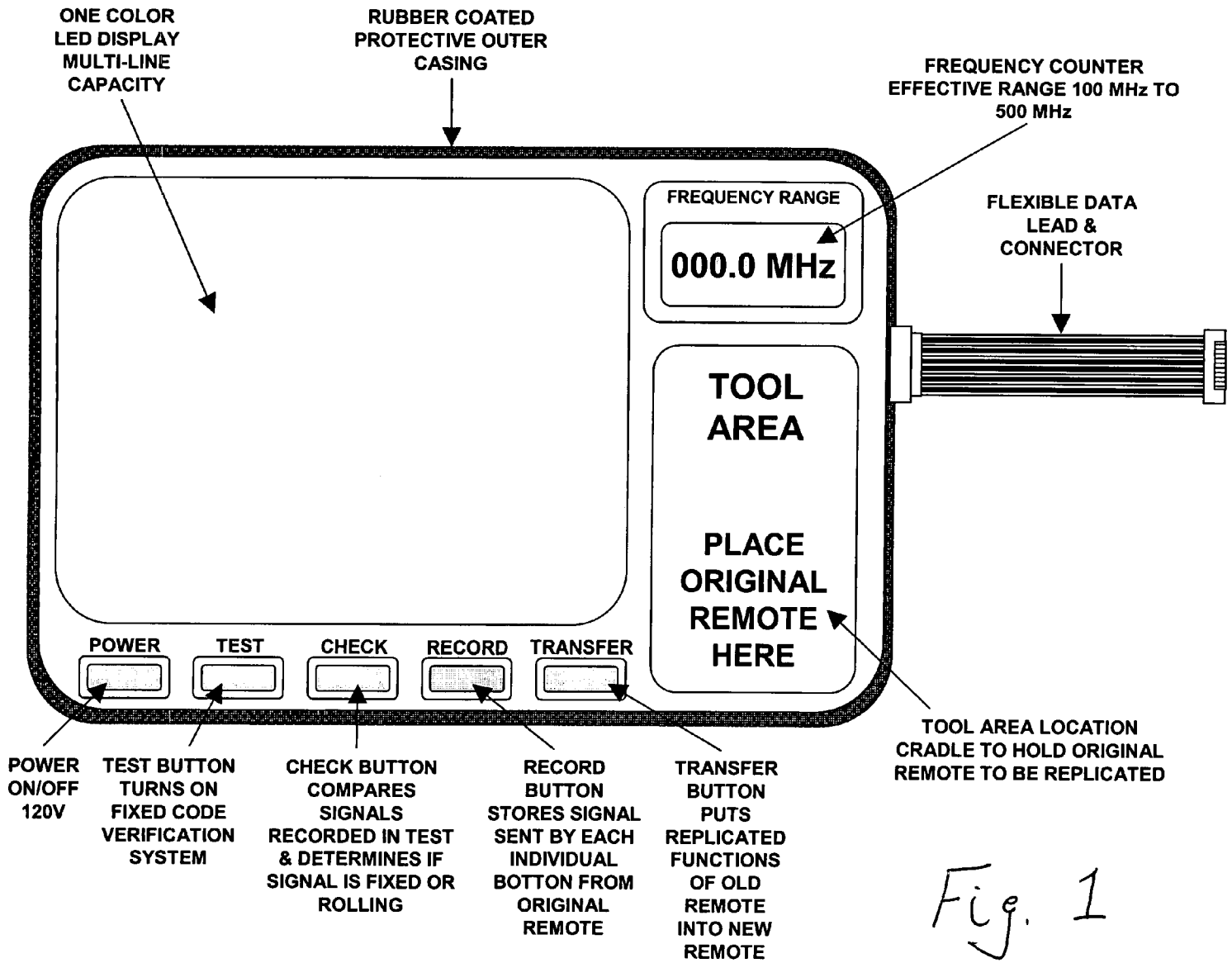
FIG. 1 is an illustration of the work area on the duplication system.
Figure 2:
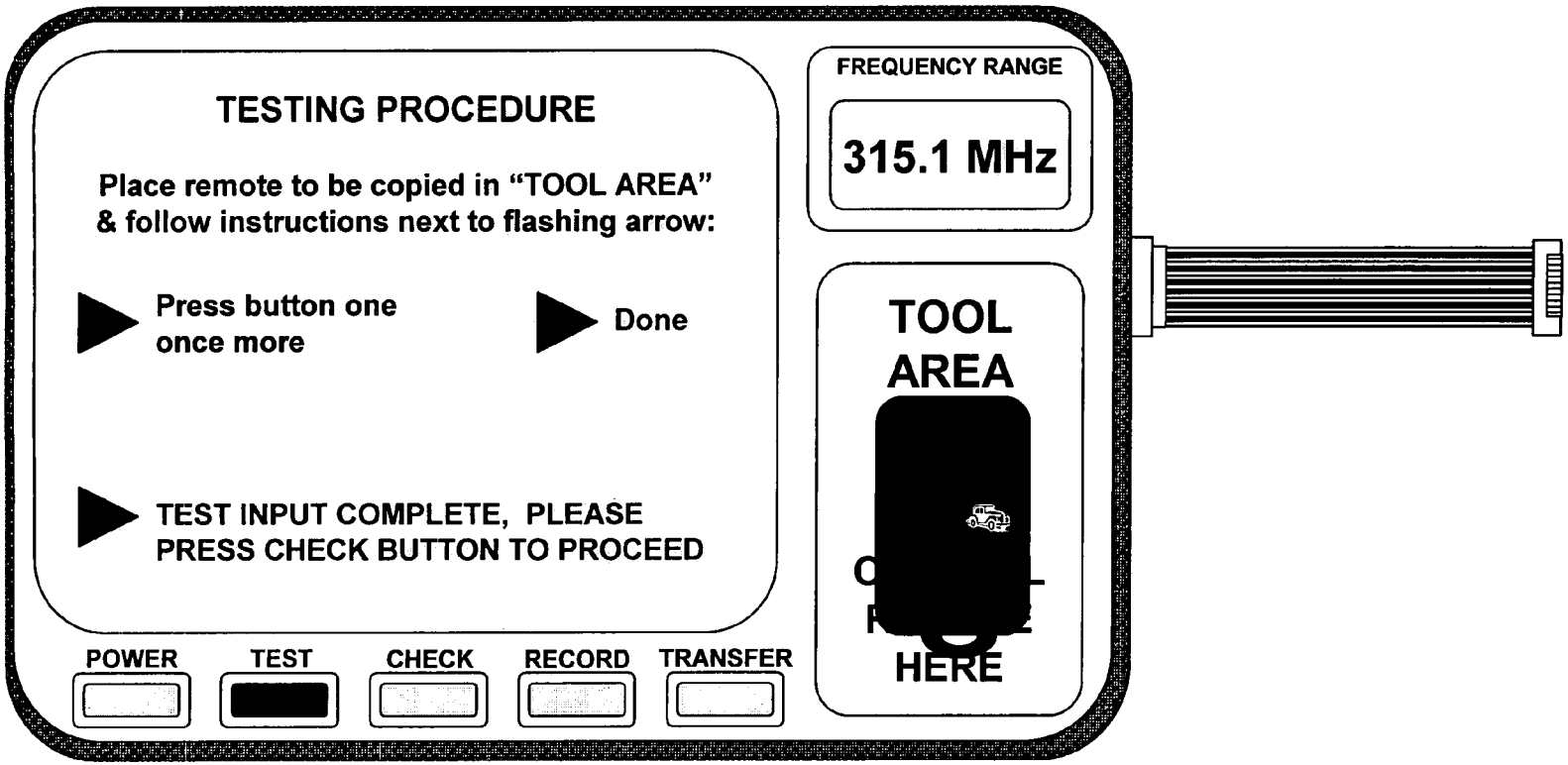
FIG. 2 is an illustration of the duplication system with a remote control installed.
Figure 3:
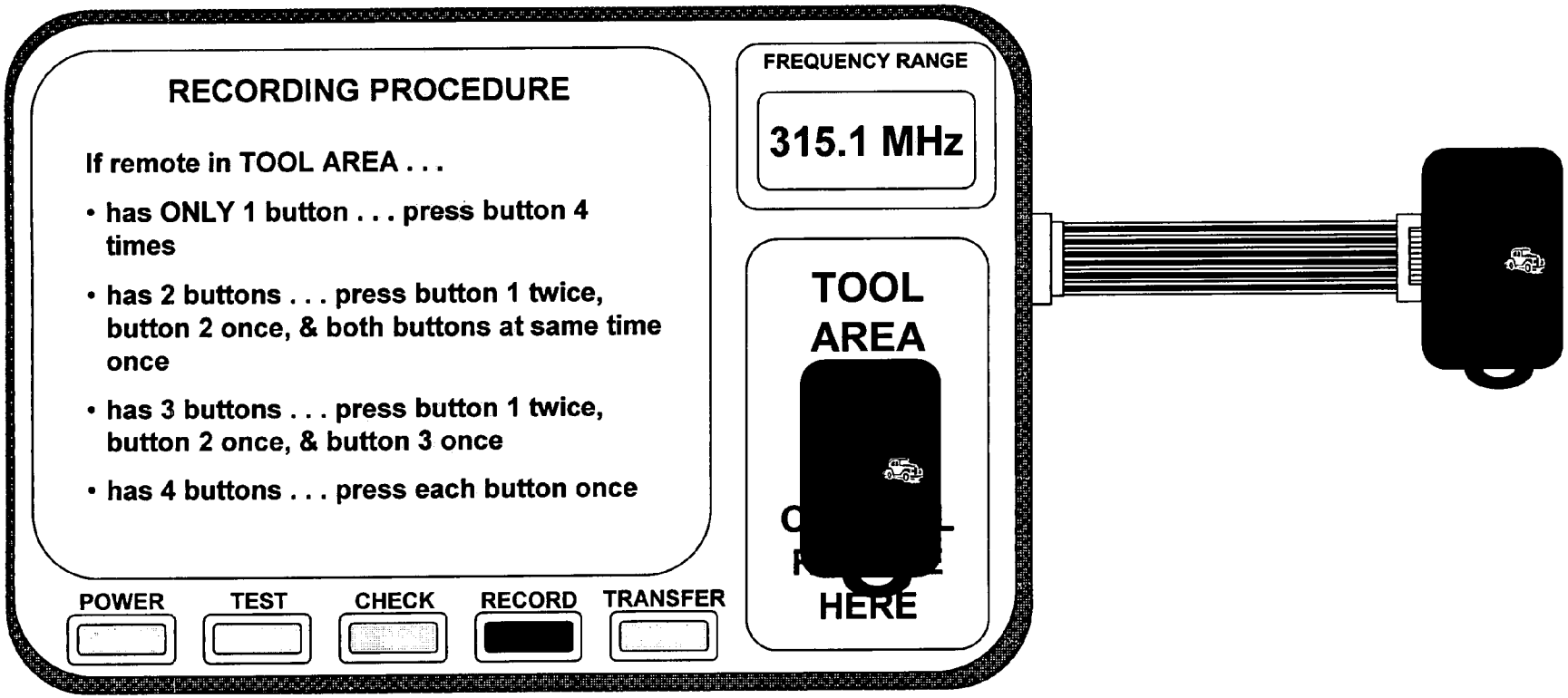
FIG. 3 is an illustration of the duplication system displaying the steps of the remote control device code recording procedure.
Figure 4:
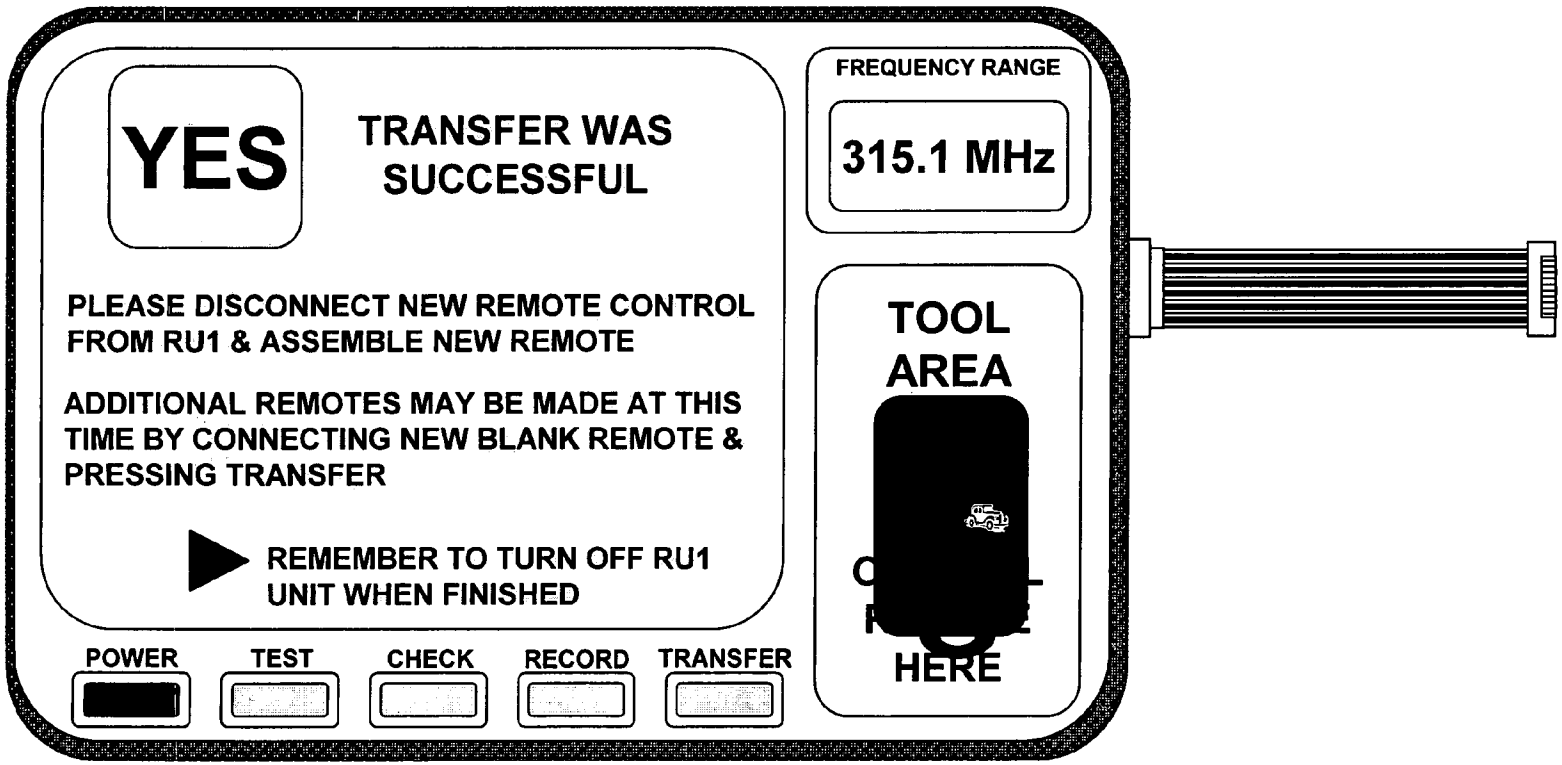
FIG. 4 is an illustration of the transfer process display on the duplication system.

The system consists of an electronic device (which we refer to as the RU-1) that accepts, stores and interprets radio frequency signal input—within a spectrum range of 100 to 500 megaHertz, common to hand-held automotive remote controls—and then exports that signal to the programmable memory chip on a replacement keyfob. The critical characteristics of the signal are its frequency and code—the latter of which represents an encoded sequence of information.

The generic set of electronic capabilities inherent in this system is found today in certain devices that have been designed and marketed principally as bench test equipment. The invention provides easy and automated commercial cloning of fixed code automotive remote controls by combining the general signal processing capabilities described above with a specific system process that supports application of RF signal cloning to replacement automotive remote controls. The invention process, effected through software that implements the process, makes it simple for a user (e.g., a store clerk) to:

(1) determine whether or not an existing automotive remote control is broadcasting a signal;

(2) determine whether or not that remote utilizes a fixed code; and then, if it is broadcasting a fixed code;

(3) copy the signal of that existing remote control onto a "blank" replacement remote transmitter.

In order to replace an automotive remote control with the typical process, one has to:

(1) determine specifications of the part in use, which is often non-trivial;

(2) source an OEM replacement part or manufacture/configure/clone an "other label" replacement part; and, in most cases, (3) execute a "programming" process that causes the remote control receiver (in a vehicle) to accept the code broadcast by the new part (because the code of OEM parts randomly varies across a huge number of codes to accomplish the security aspects of its function).

Until this third step is accomplished, a replacement remote control will not work with a particular vehicle. And programming a remote control is not always easy for a consumer or untrained store clerk to successfully accomplish.

The invention eliminates the need to carry out steps (1) and (3) when a consumer has a working fixed code remote control in their possession. A fully functioning replacement can be made by a store clerk from a single, inexpensive replacement keyfob device without the need for complicated diagnosis or subsequent vehicle receiver programming. This significantly enhances the feasibility and economics of selling replacement automotive remote controls in large retail chains without a highly trained staff.

The invention involves three major components:

(1) a cloning device ("base unit") that serves as the machine for creating ("manufacturing") replacement remote clones;

(2) a programmable RF transmitter (called a replacement "keyfob" or "remote") that is attached to the base unit via a connector cable or tether during cloning and subsequently sold to the consumer as the replacement part; and, (3) a working keyfob ("source" or "existing" remote) which serves as the source of coded RF signal information for copying.

The base unit is a small table-top cubic module that may be made of durable rubber-coated plastic and/or metal construction. Inside the module are electronic components—power supply, RF receiver, printed circuit board with memory, etc.—that facilitate receipt, interpretation, storage and transfer of a locally generated RF signal between 100 and 500 megaHertz. The device may be powered by a battery and/or 120V AC cord with an external power button or switch. Transfer of the coded signal information is effected through a (fixed or detachable) data lead, cable or tether emanating from the device with an industry-standard connector at its end for communication with a programmable memory chip (located on the replacement keyfob's printed circuit board). The bottom of the device will provide an appropriate level of RF shielding to avoid random interference (in a store, automotive service area, workshop or service vehicle) with the device's function.

The top (face or front) of the device may have a depressed area (cradle) where the working keyfob will be placed during operation of the cloning process. The face bears a display for communicating test information and instructions. User input to the device is effected either via touch-screen capability of the display or via buttons located on the face of the device with appropriate descriptive labels. This device may also be configured with universal hardware connections and software that would allow it to function as a single-client or networked PC peripheral device for uploading or downloading coded signals and for keyboard-based operation and input.

The replacement keyfob has a look, material, and construction common to existing automotive remote controls. It is a battery-operated RF transmission device having some number of depressable buttons that activate electronic functions on the device's printed circuit board that yield transmission of the appropriate coded RF signal. Components include a plastic case that either snaps or screws together. Inside the case are a battery and a printed circuit board with button switches and all of the other electronic components affixed. Covering the buttons on the circuit board are rubber button covers of various colors with icons that appropriately relate to the intended function of each button. There is also a rubber bladder that serves to provide water resistance and hold components firmly in place. A small LED (usually green or red) on the face of remote lights when a button is depressed to indicate that the transmitter has battery power and is transmitting a signal.

The distinctive electronic components of the replacement keyfob used in the system are a programmable rather than a pre-loaded memory chip and a "tuneable" transmitter (that is, it's transmission frequency can be set to any frequency in the target range rather than being fixed at a single frequency). Replacement remotes typically are created with the case disassembled to provide full access to the tuning pod and programmable chip on the printed circuit board. However, the system can also be configured with an opening ("access" port") on the back of the keyfob for connecting the device tether to the programmable chip without opening the remote case. With this option, the frequency of the keyfobs may be pre-set to the dozen or so common frequencies in use for automotive remote controls and there may be a rubber insert to seal the opening after cloning.

The source remote which provides the existing coded signal for copying may be supplied either by a consumer or from an inventory of working remotes. In the former case, in which the source is a consumer's working remote, the cloned replacement will be a fully functioning duplicate remote control as soon as it is removed from the reprogramming device. However, the duplication system can also be used for "manufacturing" replacement remotes by using one or more randomly coded working OEM keyfobs as signal sources ("cloning stock"). In this case, for a consumer to use the remote control, he or she would have to program the remote to his or her vehicle in the same manner that an OEM remote would be.

General Process Description

The system of the invention performs several functions commensurate with the overarching application of cloning working fixed-code remotes. The independent functions include:

Test: The testing function involves receiving an RF signal from an existing remote and then indicating to the system user (1) the fact that the existing keyfob is transmitting, (2) the transmission frequency, and (3) whether the signal is fixed for every button press or changes with each press.

Code Recording/Storage: The recording/storage function captures and places into memory the transmitted RF signal for multiple code source instances. A typical code source instance will be a button press on an existing remote control sitting in the base unit cradle. Alternatively, pre-loaded stored signal files may be employed to enhance the "manufacturing" role of the system.

Code Transfer: This function transfers recorded signals to the replacement remote through the data lead tether.

Detailed Process Example

While the test, recording and transfer functions of the system may have independent uses; the intended broad application of the system is to clone an existing fixed code remote control. The detailed process steps of a typical cloning situation are as follows:

(1) User turns power to base unit on. {From this point forward, instructions for each step and results of actions, if relevant, may be provided on a display, making use of the device independent of separate written instructions or training. Appropriate error checking and messaging is programmed in to explain user errors, improper function sequences, perceived errors in the existing remote's signal, etc.}

(2) User is instructed to place existing remote control face up in cradle area of base unit and to press "TEST" button on base unit (physical button or virtual button on touch-screen).

(3) User instructed to press any button on existing remote control one time. {If existing remote transmits no signal within five seconds of user pressing "TEST" button—which could be due to a discharged battery or to a malfunctioning button, circuit board or transmitter—then the display indicates that no signal has been received and gives possible reasons, accompanied by instruction to try again by pressing a different button on the existing remote control.}

(4) After receiving signal from existing remote, base unit displays message that signal has been received and instructs user to press same button on existing remote control two more times.

(5) After receiving two more signal inputs, base unit compares three sample signals received from the existing keyfob and displays the average frequency in megaHertz and whether existing remote uses a fixed or rolling code. {If rolling code, message tells user that existing remote control cannot be copied and to call Remotes Unlimited to source a replacement part. If fixed code, message tells user that the remote can be cloned and to press "COPY REMOTE" button to begin cloning process.}

(6) User presses "COPY REMOTE" button on base unit (physical button or virtual button on touchscreen).

(7) Base unit displays instruction to press first button on existing remote control (and displays examples of various button configurations indicating which button is considered button one, two and so forth.

(8) After receiving signal input from existing remote control, base unit displays (various button configurations again) along with message indicating that the code for button one has been stored and instructing user to press button two (if any) on existing remote or "COPY REMOTE" button again if there are no more buttons on existing remote. {This sequence continues until all of the buttons on the existing remote have been copied into storage and user has pressed the "COPY REMOTE" button again indicating completion of the copying phase.}

(9) Once "COPY REMOTE" button has been pressed a second time (following storage of signals from each of the existing remote buttons), base unit displays message to instructing user to remove existing remote from cradle area and to press "TRANSFER CODE" button to continue with cloning of replacement remote.

(10) User presses "TRANSFER CODE" button.

(11) Base unit displays message indicating which replacement keyfob SKU is required to make the copy (assuming pre-set frequencies are being utilized for the replacement parts). Unit displays instructions on how to attach the data lead tether to the programmable memory connector on the replacement part circuit board (or in the case opening on the back of the remote case, if applicable). Unit also displays instruction for user to press "TRANSFER CODE" button again once the connection has been made.

(12) User presses "TRANSFER CODE" button to move the stored signals into memory on the replacement remote control.

(13) When transfer is complete, base unit displays instructions on how to detach the data lead tether, finish the programming process, complete reassembly of the remote control and continue with further system options. For making another clone of the same existing remote control, user is instructed to attach another "blank" replacement part and press "TRANSFER CODE" again. If no further clones are desired, user is instructed to place the replacement remote control in the cradle area of the base unit and press "TEST".

(14) User is then instructed to press button one on the replacement keyfob.

(15) After receiving signal from replacement remote control, base unit compares signal with stored signals from mos t recent existing remote control and displays message confirming that replacement remote's signal for button one matches the signal from button "X" of the source remote.

(16) User is instructed to press button two on replacement remote and the process continues until all buttons on clone have been tested.

(17) Base unit confirms successful cloning of the remote, reminds the user to test the cloned remote with the actual vehicle system as soon as possible, and instructs user to turn power off to clear the stored codes and reset the system. {Power has automatic shut-off time-out after a few minutes for security reasons and to preserve battery life.}

Automotive Remote Controls ("ARCs")

Automotive remote controls are provided as original equipment with many vehicles to actuate the vehicles' keyless entry systems. Remote controls are also provided with aftermarket alarm systems. As with any remote activation device, ARCs involve a means of communication and a message or messages to be communicated from the remote unit (transmitter) to the vehicle base unit (receiver). Nearly all alarm/keyless entry ("A/KE") systems utilize radio frequency transmission (in the 300 to 435 MHz range), though a handful of systems communicate via infrared signals. The message is a short sequence of numbers that registers with the base unit and tells it to perform a certain function—open the door locks, turn off the alarm protection, open the trunk, etc.

In order to provide adequate security, automotive A/KE system transmissions are coded. That is, the message being transmitted is different for two different systems of the same make and model so that the ARC from one does not operate the other. This "encryption" complicates the ARC replacement process because it means that either (1) the replacement remote must be matched to the message expected by the base unit (via programming or the manipulation of switches or circuitry); or (2) the base unit must be taught (via re-programing) to use the message contained in the replacement ARC.

In "fixed code" remote controls, which is all that the RU-1 can clone, the wave form broadcast differs for each button on the remote control but does not change over time; that is, each time button #1 is pressed, the same signal is generated. In an effort to improve the security provided by A/KE systems, manufacturers began some years ago to sell systems that operate with a so-called "rolling code". In rolling code systems, each time the ARC transmits a signal to the base unit, it sends a new message that represents an incremental change from the prior code. Software in the receiving unit instructs it to look for the new incremented code, rather than for the same code it received in the prior transmission. Systems that do not rely on incremented messages are known as "fixed code". Increasingly, rolling code technology is being used by the industry due to the fact that fixed code signals can be copied and therefore may not be as secure.

There are alternative embodiments of the system of the invention. A first alternative is a device for the creation of fixed code replacement remote controls. It includes a much larger memory capacity, onto which is pre-loaded multiple random code samples for all of the fixed code remotes known (which number several hundred distinct ARCs). This means that this embodiment of the invention, in addition to being able to clone an existing working remote control that is physically present, is able to "manufacture" on demand a replacement remote control for any fixed code ARC without having a working sample present. Because the ARCs produced in this manner do not share the code of a consumer's existing remote, the replacement part must be programmed with the vehicle just like an OE replacement part.

In order to designate the ARC specification to be applied in the replacement remote manufacturing process, the user will diagnose the part needed from an available database of information and then enter an appropriate code into the duplicator to select the appropriate file of stored coded signals. The stored code samples include numerous distinct codes for each individual ARC specification so that replacement ARCs made with the invention will not all be functionally equivalent. The invention systematically rotates or randomly alters the code it uses for a given ARC specification to ensure that maximum genetic diversity is effected.

A second alternative embodiment of the invention is a clone manufacturing device that extends the capabilities of the invention to include replication of rolling-code ARCs. Whereas the first alternative embodiment improves on the invention primarily by loading many examples of fixed code signals into the base unit's memory and then providing a means for selecting which of those stored codes to transmit to the replacement part, the second alternative requires more sophisticated processing capabilities in the base unit and different chip components in the replacement keyfob, as well as the utilization of algorithim-based code generation (and encryption) licensed from the major automobile manufacturers or their tier one suppliers.

What is claimed is:

1. A process for duplicating the programming of a remote control device comprising the steps:

testing an existing remote control unit by activating a single control input on the unit;

receiving a signal, with a base unit, from the existing remote control unit upon testing, said signal comprising a transmission frequency and a code having a type and content;

displaying a feedback message that confirms reception of said signal;

repeating the testing and receiving steps at least once more;

comparing the signals received from the remote control unit and determining the average frequency and the code type employed in the remote control unit;

storing the code content if the average frequency and code type indicates a fixed code;

repeating the testing and storage for each control input on the remote control unit; and transferring the stored code from said base unit into a replacement remote control unit.

* * * * *